US005564335A

United States Patent [19]

Motoe et al.

[11] Patent Number: 5,564,335

[45] Date of Patent: Oct. 15, 1996

[54] STENCIL DISCHARGER AND STENCIL DISCHARGE BOX

[75] Inventors: Katsuro Motoe, Tsuchiura; Shigenori Ishii, Ibaraki-ken, both of Japan

[73] Assignee: Riso Kagaku Corporation, Tokyo, Japan

[21] Appl. No.: 272,340

[22] Filed: Jul. 8, 1994

[30] Foreign Application Priority Data

Jul. 16, 1993 [JP] Japan ..... 5-176880
Nov. 11, 1993 [JP] Japan ..... 5-282668

[51] Int. Cl.[6] ..... B41L 13/06

[52] U.S. Cl. ..... 101/114; 101/116

[58] Field of Search ..... 101/114, 116–119, 101/121, 122, 128, 128.1, 128.21, 128.4, 129, 127.1, 477

[56] References Cited

U.S. PATENT DOCUMENTS

| | | | |
|---|---|---|---|
| 4,134,338 | 1/1979 | Selman | 101/122 |
| 4,404,902 | 9/1983 | Horii et al. | 101/122 |
| 5,090,310 | 2/1992 | Motoe | 101/114 |

FOREIGN PATENT DOCUMENTS

| | | | |
|---|---|---|---|
| 11281 | 1/1984 | Japan | 101/122 |
| 6492 | 1/1985 | Japan | 101/114 |
| 224573 | 11/1985 | Japan | 101/477 |
| 195885 | 8/1986 | Japan | 101/114 |
| 279979 | 12/1987 | Japan | 101/116 |
| 249684 | 10/1988 | Japan | 101/128.4 |
| 57357 | 2/1990 | Japan | 101/128.4 |
| 2196901 | 5/1988 | United Kingdom | 101/116 |

*Primary Examiner*—Stephen R. Funk
*Attorney, Agent, or Firm*—Kanesaka & Takeuchi

[57] ABSTRACT

A stencil discharger includes a stripping device for removing a spent stencil paper from the outer peripheral surface of a drum; a stencil holding section for holding the spent stencil paper that has been removed from the outer peripheral surface of the drum; a transport device for transporting the spent stencil paper that has been removed from the outer peripheral surface of the drum; a compression member which is openable in the direction of transport of the spent stencil paper and provided on the transport route between the transport device and the stencil holding section, to check the transport of the spent stencil paper that has been transported by the transport device; and a push-out device which opens the compression member to discharge the spent stencil paper into the stencil holding section by pushing out, from the transport device side, the spent stencil paper which has been compressed by the compression member.

14 Claims, 18 Drawing Sheets

STENCIL DISCHARGER AND STENCIL DISCHARGE BOX

BACKGROUND OF THE INVENTION

The present invention relates to a stencil discharger attached to a mimeograph equipment or other machine, for compressing:and discharging spent stencil paper, and to a stencil discharge box to be applied to the stencil discharger.

As a mimeograph, a rotary mimeograph equipment having a cylindrical drum has been known. Such a mimeograph equipment is generally provided with an ink supply means inside of the drum, and a mimeograph stencil paper can be wrapped around the outer peripheral surface of a circumferential wall which is pervious to ink. Printing is done by transporting a printing paper between the drum and an impression roller as the drum rotates.

In the above-described conventional mimeograph equipment, generally a stencil discharge means comprising stripping pawls, a take-up roller, and a stencil receiving box is provided in the vicinity of the drum. That is, the spent stencil paper is released, with its one end gripped by the stripping pawls, from the surface of the rotating drum, and then is pushed for discharging directly into the stencil discharge box.

According to a conventional stencil paper discharge means, the stencil paper is pushed into the stencil discharge box by the take-up roller which strips the stencil paper from the drum. Therefore there exists such a problem that the stencil paper in the stencil discharge box is compressed insufficiently, and when the stencil discharge box has become almost full of spent stencil paper, the stencil paper once discharged into the box floats back to cling around the take-up roller.

SUMMARY OF THE INVENTION

In view of the above-described various problems, it is an object of the present invention to provide a stencil discharger which has a larger-capacity stencil discharge box for holding spent stencil paper, and is free from the rolling, back around the take-up roller, of the spent stencil paper once discharged into the stencil discharge box.

The stencil discharger in the first aspect of the present invention is characterized by the provision of a transport means for transporting, into a stencil holding section, sheets of spent stencil paper that have been removed from the outer peripheral surface of a drum by a stripping means, a compression member, openable in the direction of transport of the stencil paper, which is located on a transport route between the transport means and the stencil holding section, for checking the further transport of the spent stencil paper that has been transported by the transport means, and for compressing the spent stencil paper, and a push-out means which discharges the spent stencil paper into the stencil holding section, with the compression member opened by pushing out the stencil paper from the transfer means side of the stencil paper that has been compressed by the compression member.

Also in the second aspect of the present invention, the compression member may be constituted of an elastic plate.

Furthermore, in the third aspect of the present invention, the compression plate may be produced of a rigid plate, and so constituted as to be constantly pressed towards the transport means side.

The stencil discharger in the fourth aspect of the present invention comprises a transport means for transporting, to a removable stencil holding section, a stencil paper released from the outer peripheral surface of a drum by a stripping means, a compression member which is elastically deformable in the direction of transport of the stencil paper and is mounted in the stencil paper receiving port of the stencil holding section to check further transport of the stencil paper that has been transported by the transport means and to squeeze the stencil paper, and a push-out means which, with the compression member opened, discharges the stencil paper into the stencil holding section by pushing the stencil paper from the transport means side of the stencil paper that has been squeezed by the compression means.

According to the first to third aspects of the present invention, the stencil paper that has been released from the stripping means is transported towards the stencil holding section by the transport means. However, since the compression member is disposed on the way of the transport route, the transport of the stencil paper is stopped and compressed. Thereafter, when the stencil paper that has been compressed is pushed on the back by the push-out means, the compression member opens to allow the discharge of the compressed stencil paper into the stencil holding section. Since the compression member returns to its original position after the discharge of the spent stencil paper into the stencil holding section, the compression member comes in between the transport means and the stencil holding section. Therefore, if some force acts to move the spent stencil paper once discharged into the stencil holding section, back towards the transport means side because the stencil discharge box has become nearly full of spent stencil paper, the backward movement of the spent stencil paper will be checked by the compression member and therefore the spent stencil paper will never be rolled back around the transport means.

Furthermore, according to the fourths aspect of the present invention, the stencil paper to the spent stencil holding sections can be similarly checked from being discharged and can be compressed when the compression member is provided in the stencil receiving section of the stencil holding section. Thereafter, when the compressed stencil paper is pushed on the back side by the push-out means, the compression member opens to allow the discharge of the compressed spent stencil paper into the stencil holding section.

Furthermore, the stencil holding section, if designed to be removable from the mimeograph equipment, can be removed from the mimeograph equipment when the stencil holding section has become full of spent stencil paper.

In this case, as the stencil paper receiving section of the stencil holding section is in a closed state, the spent stencil paper will not come out of the stencil holding section into the mimeograph equipment and accordingly the interior of the equipment will never be stained with ink.

On the other hand, in a fifth aspect of the stencil discharger of the present invention, in which the spent stencil paper stripped from the outer peripheral surface of the drum by the stripping means is pushed out by the push-out means for discharge into the stencil holding section, an inclined guide section is provided, in the stencil holding section, for guiding the stencil paper from the receiving port of the stencil holding section in the direction in which the spent stencil paper is pushed out by the push-out means.

According to the fifth aspect of the present invention, the spent stencil paper that has been stripped by the stripping means is pushed out by the push-out means for discharge into the stencil holding section. At this time, the stencil paper is guided inwards by the guide section without jamming at the vicinity of the entrance of the stencil holding section, thus improving a holding density.

Since the spent stencil paper will not gather at the vicinity of the entrance, there occurs no load relative to the rotation of the push-out means. Also, the spent stencil paper once discharged to the stencil holding section, is guided to the interior of the stencil holding section, and does not jump outside.

The stencil discharge box in the sixth aspect of the present invention, is a stencil discharge box for receiving spent stencil paper pushed out by the push-out means, at the receiving port. This box is applicable to the stencil discharger which comprises thee stripping means for releasing the spent stencil paper from the outer peripheral surface of the drum, a transport means for transporting in a specific direction the spent stencil paper that has been stripped by the stripping means, and a push-out means for pushing in a specific direction the spent stencil paper that has been transported by the transport means. Further this box is removable from the stencil discharger, and has an inclined guide section for guiding the spent stencil paper in the direction in which the spent stencil paper is pushed by the push-out means from the receiving port.

The stencil discharge box in the seventh aspect of the present invention is mounted on the receiving port side of the stencil discharge box in the sixth aspect, and has a compression member which checks the further transport of the stencil paper that has been transported by the transport means, squeezes the stencil paper, and then opens when the compressed stencil paper is pushed out by the push-out means, finally receiving the stencil paper inside.

The stencil discharge box in the eighth aspect of the present invention includes the guide section, which, in the stencil discharge box in the sixth aspect, is formed integral with the stencil discharge box at the receiving port.

The stencil discharge box in the ninth aspect of the present invention includes the guide section, which, in the stencil discharge box stated in the sixth aspect, is a member formed separate from the stencil discharge box and mounted on the stencil discharge box.

The stencil discharge box in the tenth aspect of the present invention includes the guide section, which, in the stencil discharge box in the sixth aspect, is composed of an inclined bottom surface of the stencil discharge box which continues to the receiving port.

The stencil discharge box in the eleventh aspect of the present invention includes the guide section, which, in the stencil discharge box in the eighth aspect, has elasticity so that, when pushed by the push-out means, it will rock on the center of a connecting portion whereby the box is connected to the receiving port.

The stencil discharge box in the eleventh aspect of the present invention includes the guide section, which, in the stencil discharge box of eighth or ninth aspect, has elasticity so that it will restorably deflect when pushed by the push-out means.

DESCRIPTION OF THE PREFERRED EMBODIMENTS

Figure 1:
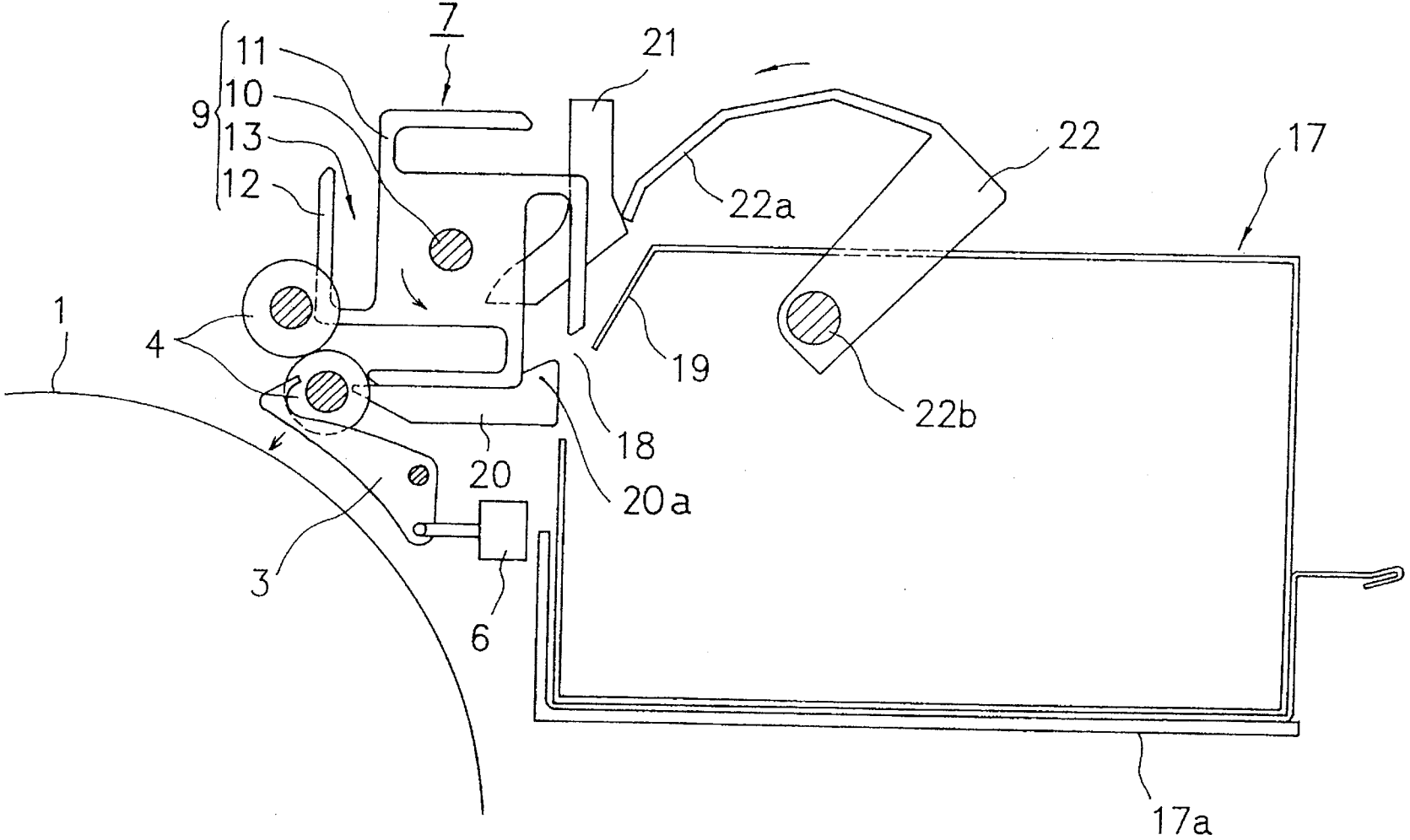
FIG. 1 is a side view showing a first embodiment of a stencil discharger according to the present invention.
Figure 2:
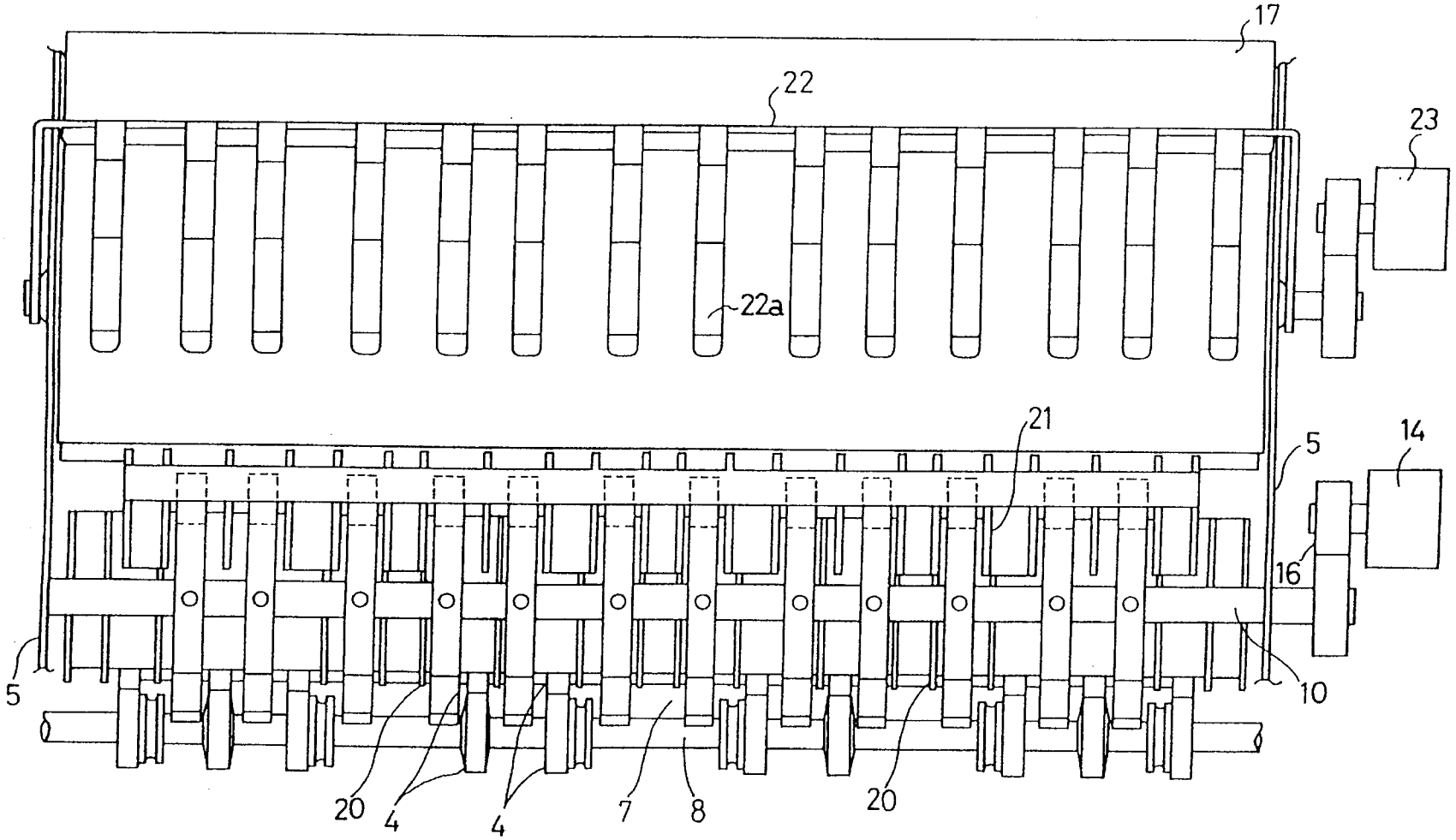
FIG. 2 is a plan view showing the first embodiment of the stencil discharger according to the present invention.

In the following, the first embodiment of the stencil discharger according to the present invention will be explained. FIG. 1 is a side view showing the stencil discharger, and FIG. 2 is a plan view thereof.

In the drawing, a reference numeral 1 refers to a drum 1 which is driven to rotate about a center axis (not shown). The drum 1 has a peripheral wall pervious to ink, and is provided inside with an ink supply means not illustrated. The stencil paper is wrapped around the outer peripheral surface. Near the outer peripheral surface of the drum 1 are provided stripping pawls 3 as stripping means for stripping a spent stencil paper from the drum 1, and take-up rollers 4. There are provided a plurality of take-up rollers 4 arranged in pairs, upper and lower, at a specific distiance in an axial direction on two shafts 8 which are rotatably supported between side plates 5.

The stripping pawl 3 is driven by a solenoid 6 such that its tip will approach the drum 1, and enters into a gap formed between the drum 1 and the end of the stencil paper unclamped from the outer peripheral surface of the drum 1, thus releasing and guiding the stencil paper to the take-up rollers 4. The take-up rollers 4 are so constituted as to hold and transport the stencil paper, thereby removing the stencil paper from the drum 1 which is rotating. The stripping pawls 3 are not necessarily required to be driven by the solenoid 6 so as to take two positions: a stripping position where the stripping pawls 3 approach the drum 1 and a waiting position where the stripping pawls 3 are off by a specific spacing from the drum 1, but may be fixedly installed in such a position that when the drum 1 is rotated clockwise in FIG. 1, with one end of the stencil paper unclamped from, and to some extent removed from, the drum 1, the thus stripped one end of the stencil paper can be guided towards the take-up rollers.

A rotating part 7 of the stencil discharger is provided adjacently to the take-up rollers 4. The rotating part 7 comprises a plurality of rotating members 9, which are fixedly installed at specific spaces on one phase on a common rotating shaft 10 which is rotatably mounted between the side plates 5. The rotating member 9 has cantilever arms 12 protrusively formed in a nearly gamma-dion shape on the four sides of an approximately square base portion 11. The rotating member 9 is designed to hold the stencil paper between the arm 12 and the base portion 11.

That is, each rotating member 9 has a holding section 13 in each arm 12, for holding the spent stencil paper released from the drum 1; the holding section 13 is open on the delay side in the direction of rotation, to receive the spent stencil paper transported from the take-up rollers 4.

The rotating shaft 10 is driven, through a gear 16, by a torque from a reversible motor 14 which is a driving means. The rotating member 9 is designed to rotate at a specific timing with the holding section 13 open to the rear.

Figure 3:
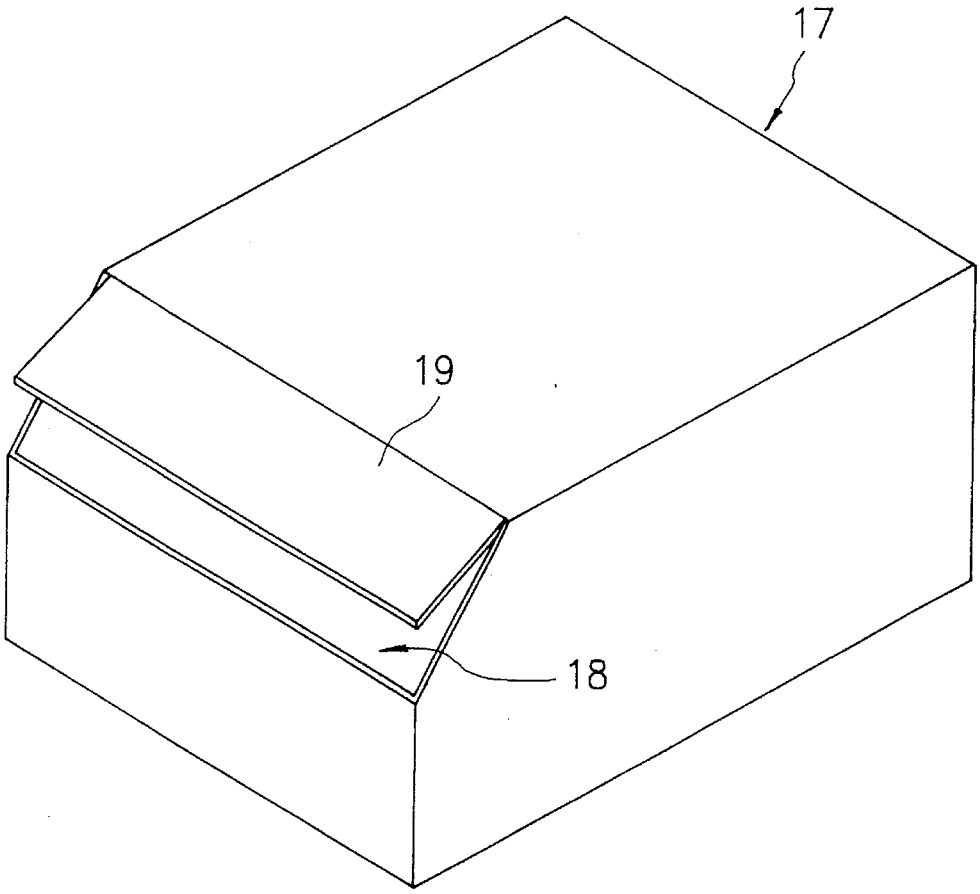
FIG. 3 is a perspective view showing a stencil discharge box of the same embodiment.

Adjacently to the rotating section 7, the stencil discharge box (stencil holding section) 17 shown in the perspective view of FIG. 3, is removably mounted on a mounting base 17*a*. The stencil discharge box 17 annexed to the stencil discharger opens at the receiving port 18, above which an openable lid (compression member) 19 is provided.

In the case of the stencil discharge box 17 formed of paper, the lid 19 can be made by cutting a groove in a part of the paper box and bending the lid portion along the groove, and is required to have sufficient elasticity for returning to the original bent position when the force applied to push the lid 19 towards the inside of the box has been released. Also the lid 19 may be formed of such an elastic body as a thin plastic plate.

The rotating section 7 is provided with a lower stencil guide 20 and an upper stencil guide 21 between the rotating member 9 and the stencil discharge box 17. The lower stencil guide 20 is protrusively provided at specific spaces in the axial direction of the rotating shaft 10; the end portion 20*a* of this stencil lower guide 20 is mounted at a specific angle of inclination relative to the angle of the lid 19.

The lower stencil guide 20, therefore, guides the spent stencil paper received in the holding section 13, towards the lid 19 of the stencil discharge box 17 when the rotating member 9 holding the spent stencil paper in the holding section 13 is rotated. Above the lower stencil guide 20, a plurality of upper stencil guides 21 inclined by a specific angle in the direction of inclination of the lid 19 are protrusively provided. The upper stencil guide 21 squeezes the spent stencil paper held in the holding section 13 towards the lid 19 as the compression member 9 is rotated with the spent stencil paper held in the holding section 13.

The lower stencil guide 20 and the upper stencil guide 21 are located in front of the stencil discharge box 17, in a space between the rotating members 9, so that these guides will not interfere with each of the rotating member 9. That is, the rotating member 9 and the stencil guides 20 and 21 are assembled like inserts and therefore will never interfere with each other.

Between the stencil guide 21 and the lid 19 is rotatably mounted the push-out means 22 for pushing, towards the inside of the stencil discharge box 17, the spent stencil paper which has been compressed between the upper stencil guide 21 and the lid 19 of the stencil discharge box 17. This push-out means 22 is of an inversed U-shaped plate, both ends of which are rotatably supported on a shaft 22*b*; on the drum 1 side of the upper surface of the plate, a plurality of push-out pieces 22*a* formed in a specific circular arc type are mounted at specific spaces on the center of the shaft 22*b*. The push-out means 22 is driven to rotate by a motor 23 between the waiting position where the forward end of the push-out piece 22*a* is positioned on the upper surface of the stencil discharge box 17 as shown in FIG. 1 and the position of operation where the forward end of the push-out piece 22*a* is positioned in the stencil discharge box 17, that is, the position where the spent stencil paper which has been squeezed between the upper stencil guide 21 and the lid 19 of the stencil discharge box 17 can be discharged completely into the stencil discharge box 17. Therefore, with the rotation of the push-out means 22, the lid 19 also is rotated on the support of the bending section into the stencil discharge box 17.

Next, the operation of the stencil discharger of the above-described constitution will be explained by referring to the operation diagrams of FIGS. 4 to 10.

The stencil paper P wrapped around the drum 1, when used up, will be disposed of as a spent stencil paper.

When the stencil paper P clamped by a clamp means not shown which is provided on the outside surface of the drum 1 is unclamped, the tip of the stripping pawl 3 contacts the drum 1 while the drum 1 is rotating, and enters between the drum 1 and the leading end of the stencil paper P to thereby release the stencil paper P from the outer peripheral surface of the drum 1.

Figure 4:
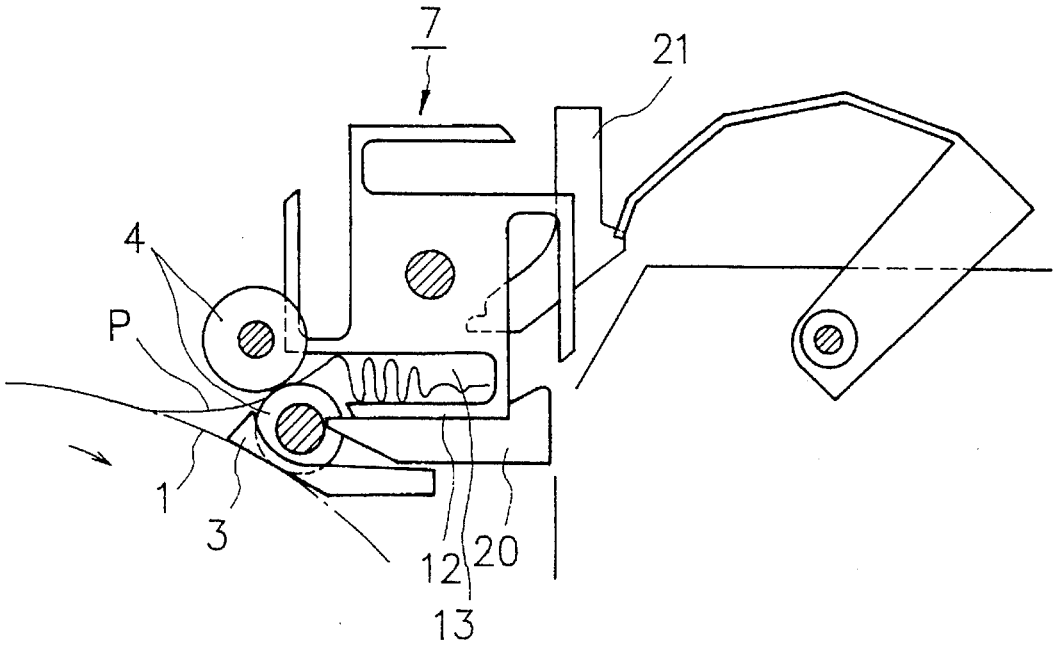
FIG. 4 is an operation diagram of the same embodiment.
Figure 5:
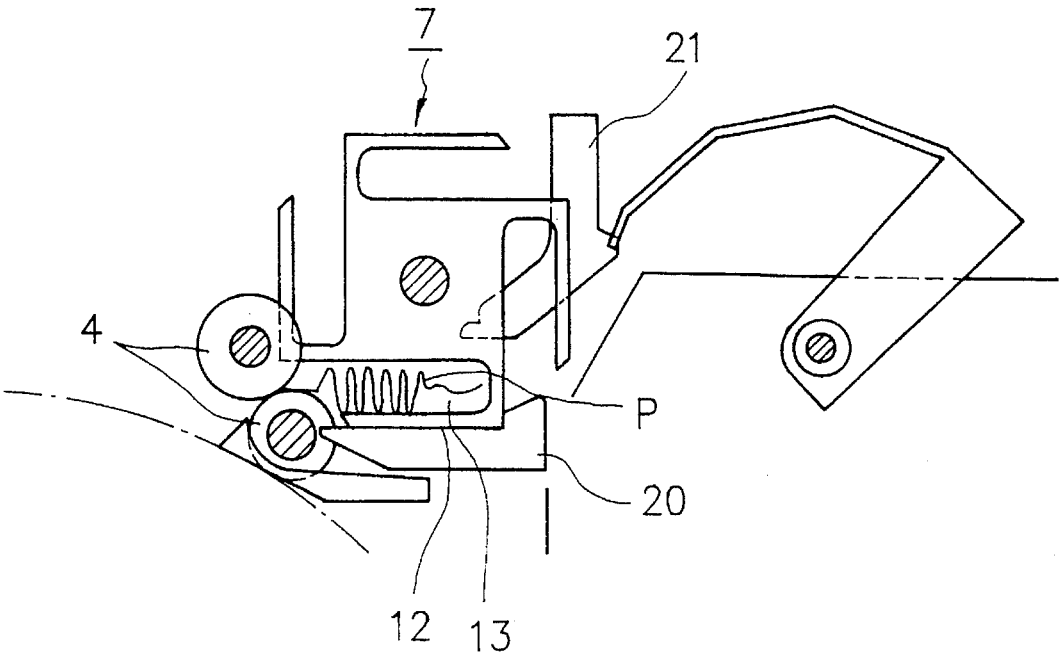
FIG. 5 is an operation diagram of the same.

Subsequently, as shown in FIG. 4, the stencil paper P is peeled from the drum 1 and transported as the take-up rollers 4 turn, thus being compressed and received in the holding section 13 of the rotating member 9.

Figure 6:
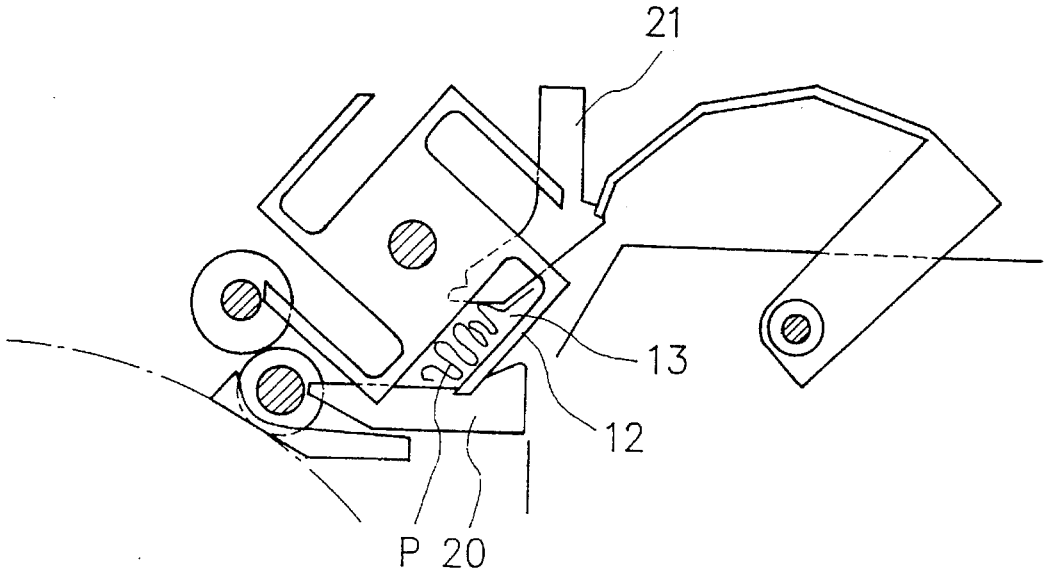
FIG. 6 is an operation diagram of the same.

Next, with the rotation of the rotating member 9 which is driven by the motor 14 as shown in FIG. 6, the spent stencil paper P received in the holding section 13 is guided by the lower stencil guide 20 and the upper stencil guide 21, moving towards the stencil discharge box 17.

Figure 7:
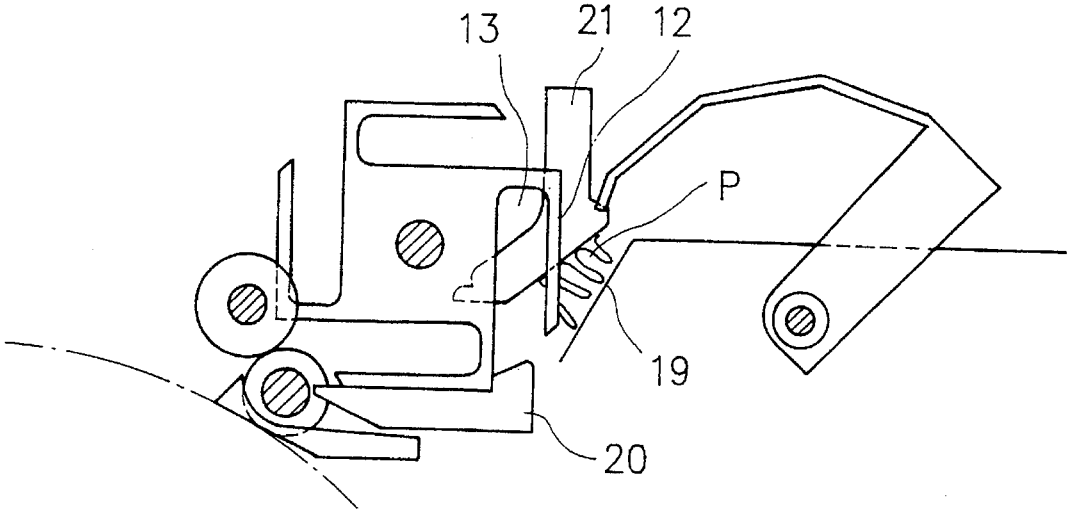
FIG. 7 is an operation diagram of the same.

Subsequently, as shown in FIG. 7, the spent stencil paper P moving towards the stencil discharge box 17 side is stopped by the lid 19, to be further squeezed between the stencil guide 21 and the lid 19.

Figure 8:
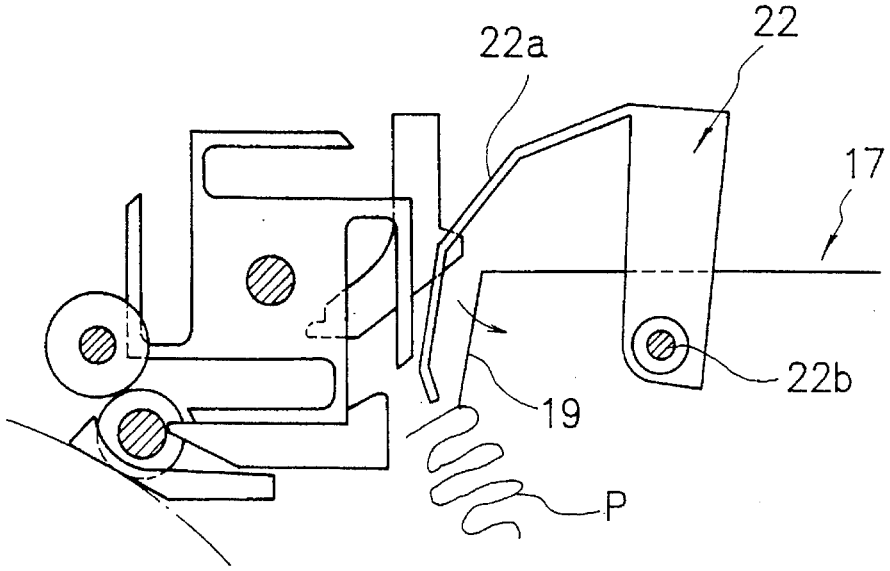
FIG. 8 is an operation diagram of the same.
Figure 9:
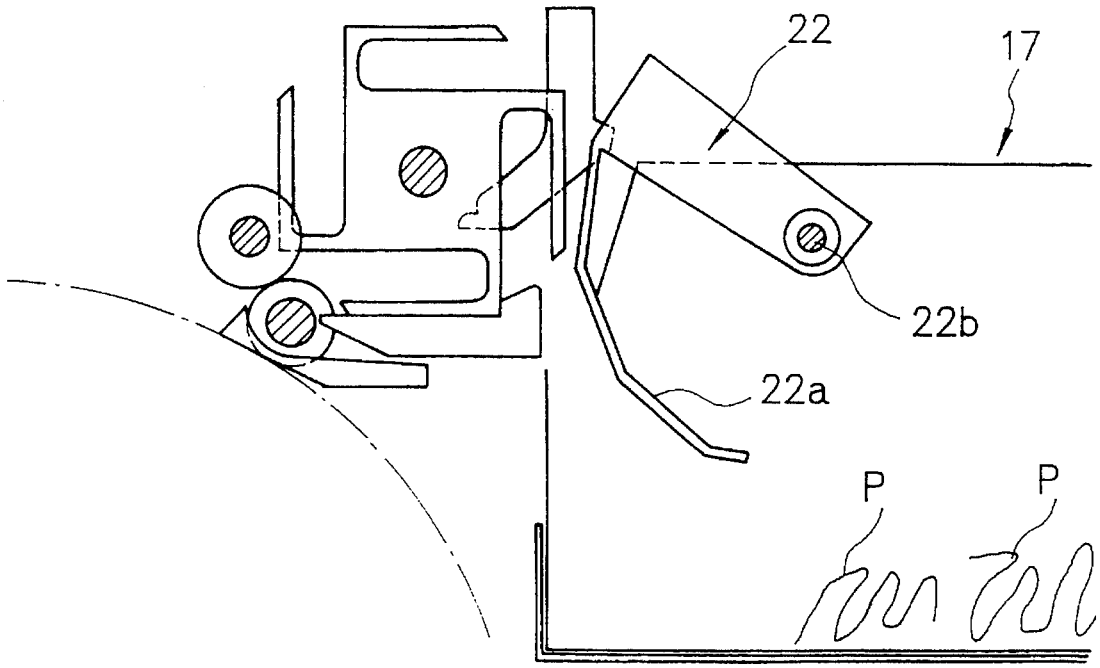
FIG. 9 is an operation diagram of the same.

Subsequently, as shown in FIG. 8, as the motor 23 turns normally to drive the push-out means 22, the spent stencil paper P is further compressed by means of the push-out piece 22*a*, while being pushed out towards the stencil discharge box 17 side. At this time, the lid 19 together with the spent stencil paper P is pushed towards the inside of the stencil discharge box 17. The spent stencil paper P, therefore, is fully discharged into the stencil discharge box 17 as shown in FIG. 9.

Figure 10:
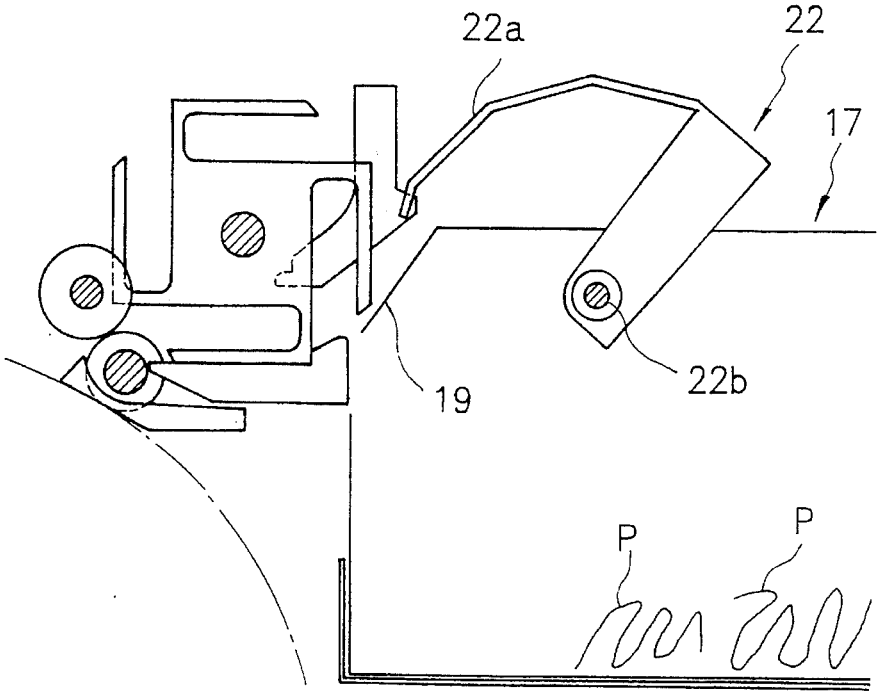
FIG. 10 is an operation diagram of the same.

Subsequently, with the reverse rotation of the motor 23, the push-out means 22 stops pushing, allowing the lid 19 to move backwardly to its original position as shown in FIG. 10. That is, the lid 19 returns to the position where the movement of the spent stencil paper P from the rotating member 9 is checked. The operation of the push-out means 22 is not limited to only once, but may be repeated for plural times, e.g., two to three times.

After the discharge of the spent stencil paper P into the stencil discharge box 17, the lid 19 returns to its original position; namely, the lid 19 is present between the rotating member 9 and the stencil discharge box 17. Therefore, when the stencil discharge box 17 has become full of the spent stencil paper P and if a force acts to move the spent stencil paper P discharged into the stencil discharge box 17, backwardly towards the rotating member 9 side, the backward movement of the spent stencil paper P will be checked by the lid 19. Therefore, there will not occur such troubles as interrupted rotation of the rotating member 9, defective discharge of the spent stencil paper, and wrapping of the defectively discharged spent stencil paper around the take-up roller 4.

The spent stencil paper P discharged into the stencil discharge box 17 can be discarded outside by removing the stencil discharge box 17 itself off the mounting base 17*a* and opening the receiving port 18. At this time, if the stencil discharge box 17 is turned upside down with the receiving port 18 facing downwardly, the spent stencil paper P will not drop out of the box thanks to the elasticity of the lid 19, and accordingly will not stain the interior of the equipment with ink.

Figure 11:
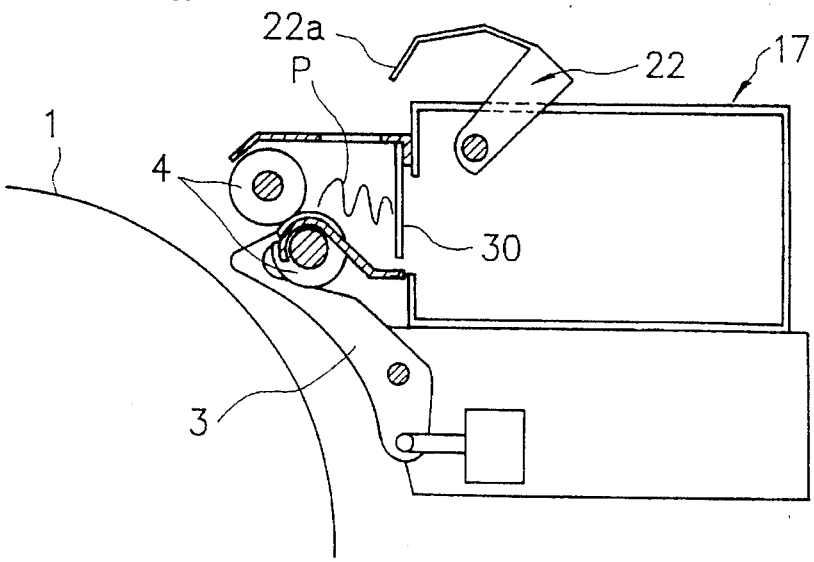
FIG. 11 is a side view showing a second embodiment of the stencil discharger according to the present invention.

Next, FIG. 11 is a side view showing the second embodiment of the stencil discharger according to the present invention. It should be noted that the same members as those in the first embodiment described above are designated by the same reference numerals, and therefore will not be described.

In the second embodiment, the spent stencil paper P that has been released by the stripping pawls 3 from the drum 1 is transported by the take-up rollers 4 into the stencil discharge box 17 fixedly mounted to the equipment. Therefore, the stencil discharger is not equipped with the arm 12 and the stencil guides 20 and 21 described above.

On the way of the stencil paper transport route between the take-up rollers 4 and the stencil discharge box 17 is provided an elastic plate (compression member) 30 fixed at one end. This elastic plate 30 is made of a rubber plate, a thin plastic plate, or other, and squeezes the spent stencil paper P as shown in FIG. 11.

Figure 12:
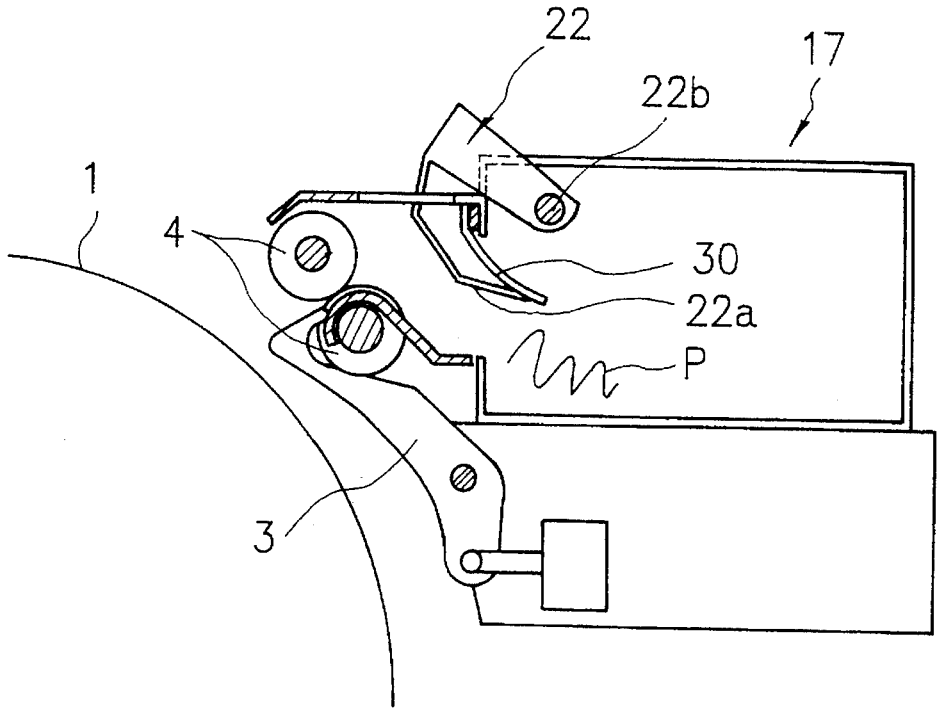
FIG. 12 is an operation diagram of the embodiment.

Therefore, as shown in FIG. 12, the spent stencil paper P compressed by the elastic plate 30 is pushed out by the push-out means 22 from the take-up roller 4 side. At this time, the elastic plate 30 deflects to discharge the spent stencil paper P into the stencil discharge box 17. When the push-out means 22 is released, the elastic plate 30 returns to the original position.

Figure 13:
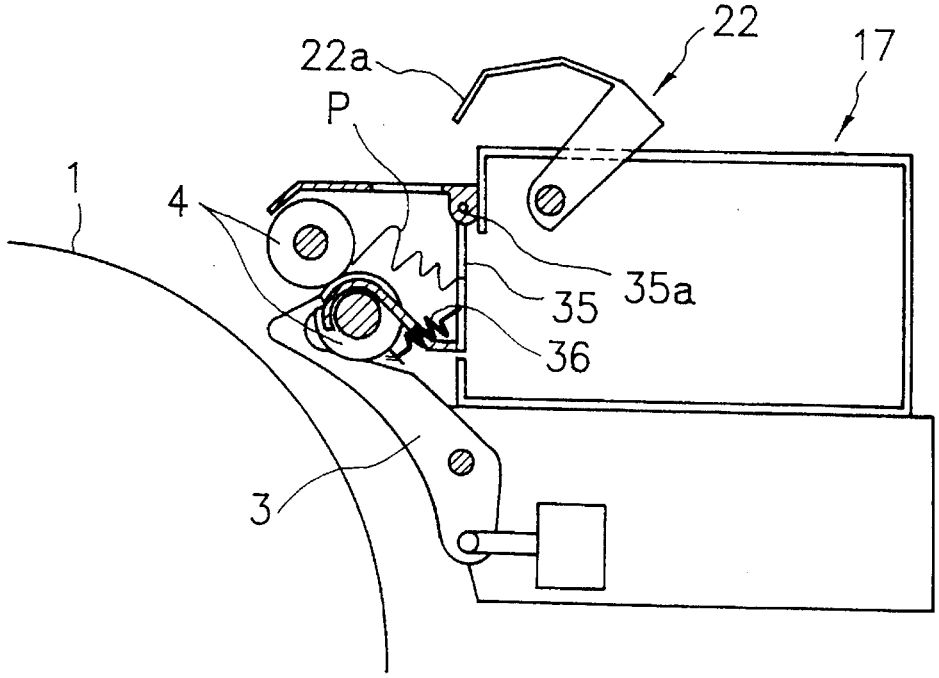
FIG. 13 is a side view showing a third embodiment of the stencil discharger according to the present invention.
Figure 14:
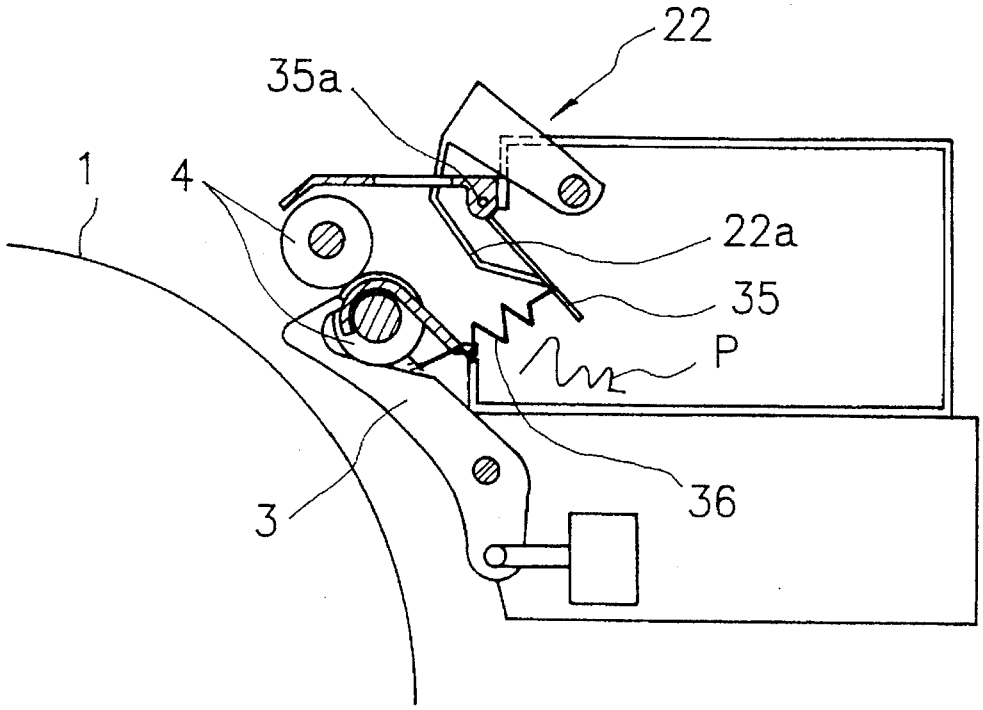
FIG. 14 is an operation diagram of the same embodiment.
Figure 15:
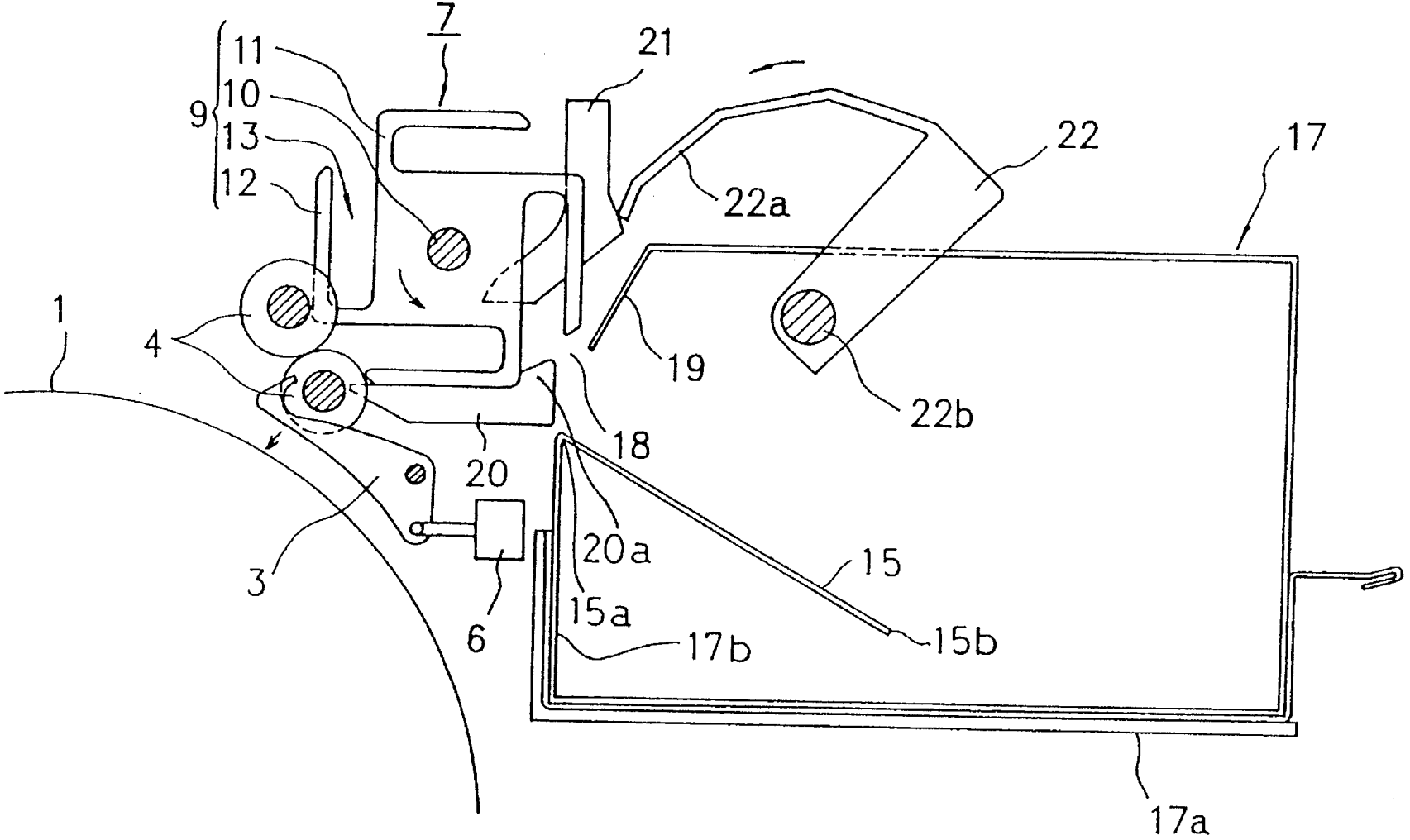
FIG. 15 is a side view showing a fourth embodiment of the stencil discharger according to the present invention.
Figure 16:
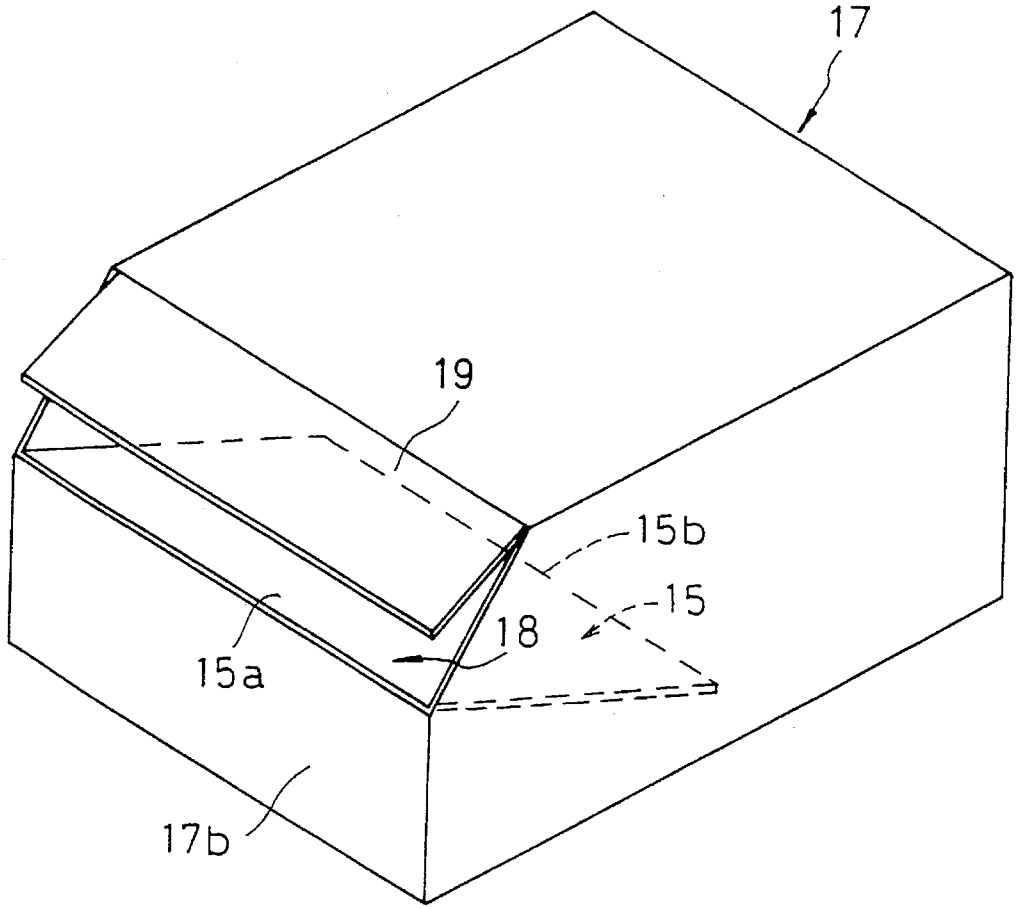
FIG. 16 is a perspective view showing the stencil discharge box of the same embodiment.

FIG. 13 is a side view showing the third embodiment of the stencil discharger according to the present invention, and is a modification of the second embodiment described above. In the present embodiment, there is provided a rigid plate (compression means) 35 rotatably supported at one end 35*a* in place of the elastic plate 30. The rigid plate 35 may be so formed as to be pressed with a specific force of a spring 36 toward closing the opening section.

The spent stencil paper P stated above is thus compressed by the rigid plate 35 with the transport force of the take-up rollers 4, and is discharged into the stencil discharge box 17 by the push-out means 22. In the second and third embodiments, the stencil discharge box 17 is so constituted as to be fixedly mounted to the equipment, and may be designed removable from the equipment.

According to the first aspect of the present invention, the compression member is disposed between the transport means and the stencil holding section, on the way of the spent stencil paper transport route. The compression member squeezes the spent stencil paper while checking the movement of the spent stencil paper. Then the compression member is released by the push-out means to allow the discharge of the spent stencil paper into the stencil paper holding section. The spent stencil paper once discharged, therefore, can be prevented from going back out of the stencil paper holding section. In the present embodiment, therefore, there will never take place such a serious trouble that the transport of the spent stencil paper thus discharged accidentally stops between the stencil holding section and the transport means; and consequently the spent stencil paper can be discharged smoothly without going back onto the take-up rollers and ac accordingly without disturbing the rotation of the take-up rollers.

Furthermore, in one aspect of the invention, the provision of the compression member in the stencil holding section can simplify the constitution of the stencil discharger, and in addition the stencil holding section can be detached from the equipment when it has become full of spent stencil paper and carried to a place of disposal. In this case, since the stencil paper receiving section of the stencil holding section is closed, no spent stencil paper will drop into, and stain with ink, the interior of the equipment from the stencil holding section.

The fourth embodiment of the present invention will be explained with reference to FIGS. 15 to 23. Members of the same constitution as those in the first embodiment are designated by the same reference numerals used in FIGS. 15 and 16 and will not be explained.

The stencil discharge box 17 of the present embodiment is provided with the receiving port 18 formed open in the upper part of the side wall 17*b* on the drum side. Above the opening is located the lid (compression member) 19 which is openable.

In the inside of the stencil discharge box 17 is provided a guide section 15. The guide section 15 is a plate inclined to a specific degree with its one end 15*a* forming the uppermost portion at the receiving port 18 and the other end 15*b* extending to the bottom portion nearly at the center of the stencil discharge box.

The guide section 15 may be formed integral with, and continuing to, side wall 17*b* in the case the stencil discharge box 17 is made of paper, particularly of cardboard. In this case, the guide section 15 can be formed simply by bending at the one end 15*a* which continues to the side wall 17*b*. In this case, the inclination may be formed either with the other end 15*b* of the guide section 15 held in contact with the bottom and side of the stencil discharge box 17 or with the other end 15*b* of the guide section 15 left free from the bottom and side of the stencil discharge box 17 so that the guide section 15, having elasticity, can make a rocking motion on the center of the bent portion.

Next, the discharge operation of the stencil discharger of the above-described constitution will be explained by referring to the operation diagrams of FIGS. 17 to 23.

Prior to initiating printing with a new stencil paper, a used stencil paper P wrapped on the drum 1 must be removed and disposed of.

Figure 17:
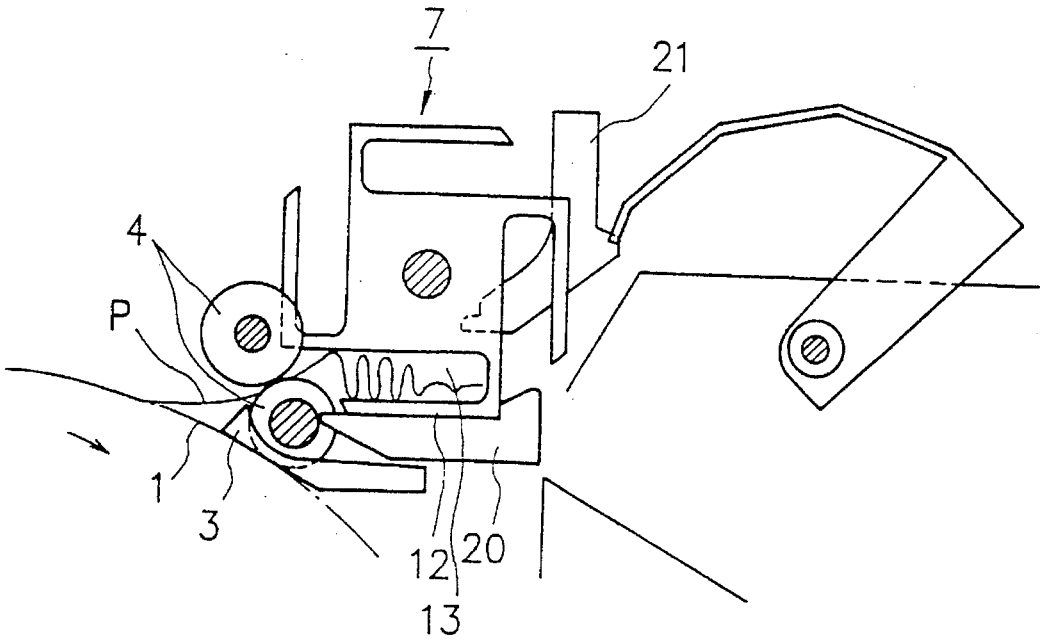
FIG. 17 is an operation diagram of the equipment of the same embodiment.

Thus the stencil paper P secured by a clamp means not shown provided on the outer peripheral surface of the drum 1 is unclamped, and thereafter, as shown in FIG. 17, is stripped from the outer peripheral surface of the drum 1 by the tip of the stripping pawl 3 which is approaching the drum 1 and wedging in between the drum 1 and the leading end of the stencil paper P as the drum 1 rotates.

Figure 18:
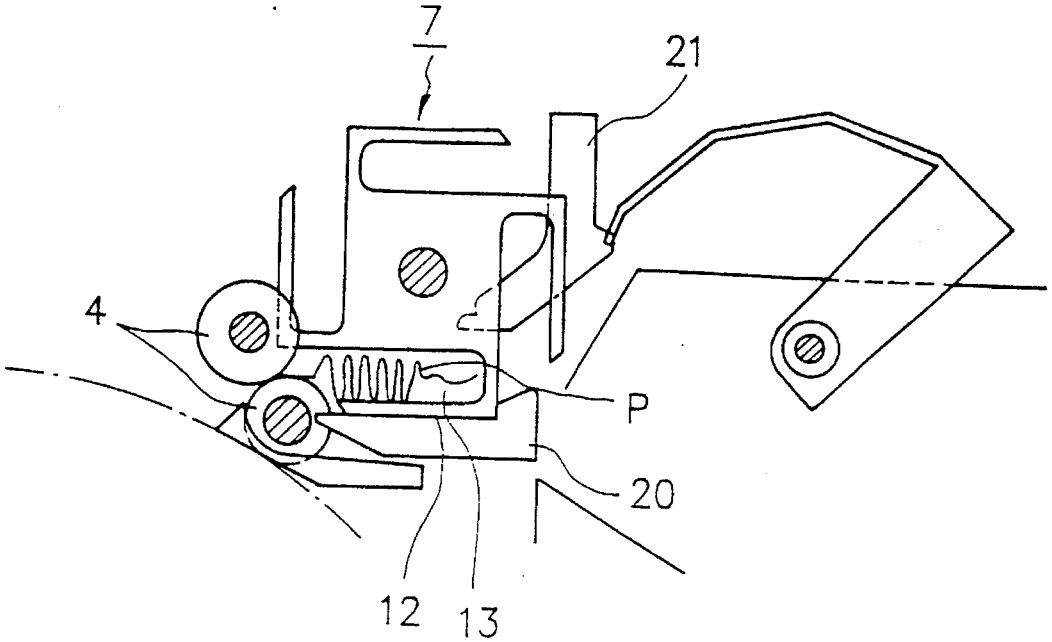
FIG. 18 is an operation diagram of the same.

Subsequently, as shown in FIG. 18, the spent stencil paper P is stripped from the drum 1 and carried with the rotation of the transport roller 4 into the holding section 13 of the rotating member 9, where the spent stencil paper P is compressed and held.

Figure 19:
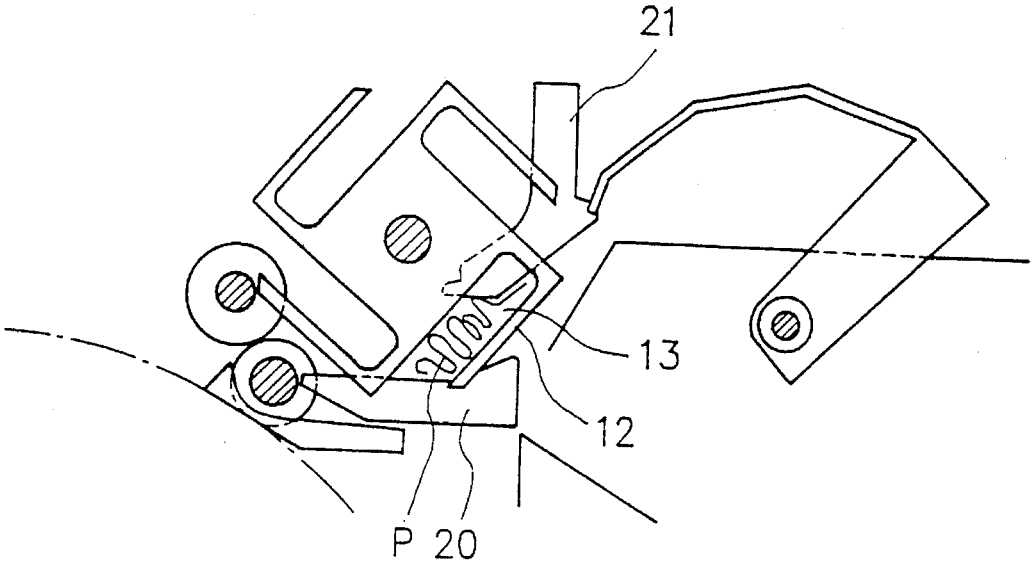
FIG. 19 is an operation diagram of the same.

Next, as shown in FIG. 19, as the rotating member 9 is turned by the motor 14, the spent stencil paper P held in the holding section 13 is guided by the stencil guides 20 and 21, moving towards the stencil discharge box 17.

Figure 20:
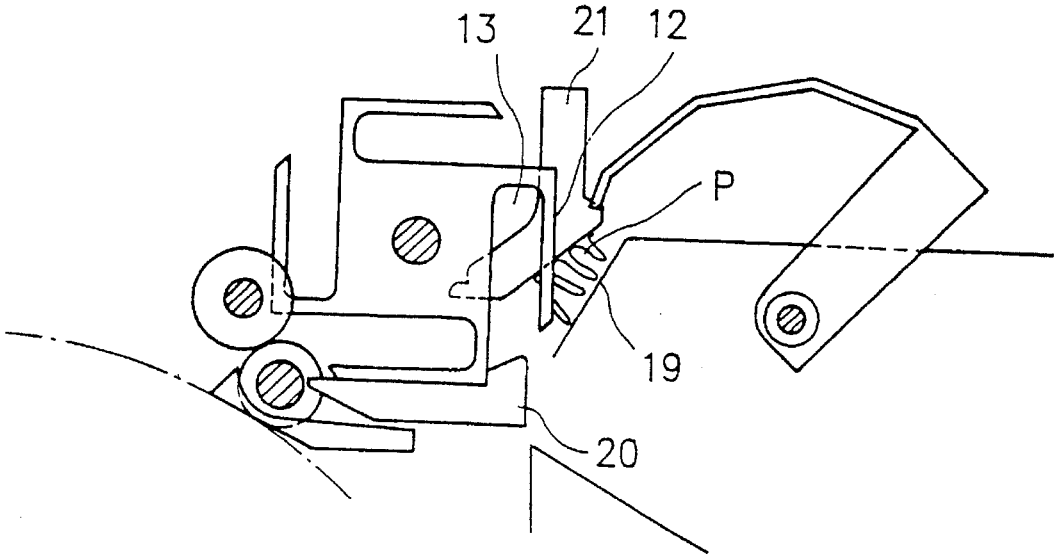
FIG. 20 is an operation diagram of the same.

Subsequently, as shown in FIG. 20, the spent stencil paper P tends to move towards the stencil discharge box 17 side, but the spent stencil paper is prevented by the lid 19 from moving, being further squeezed between the stencil guides 20 and 21 and the lid 19.

Figure 21:
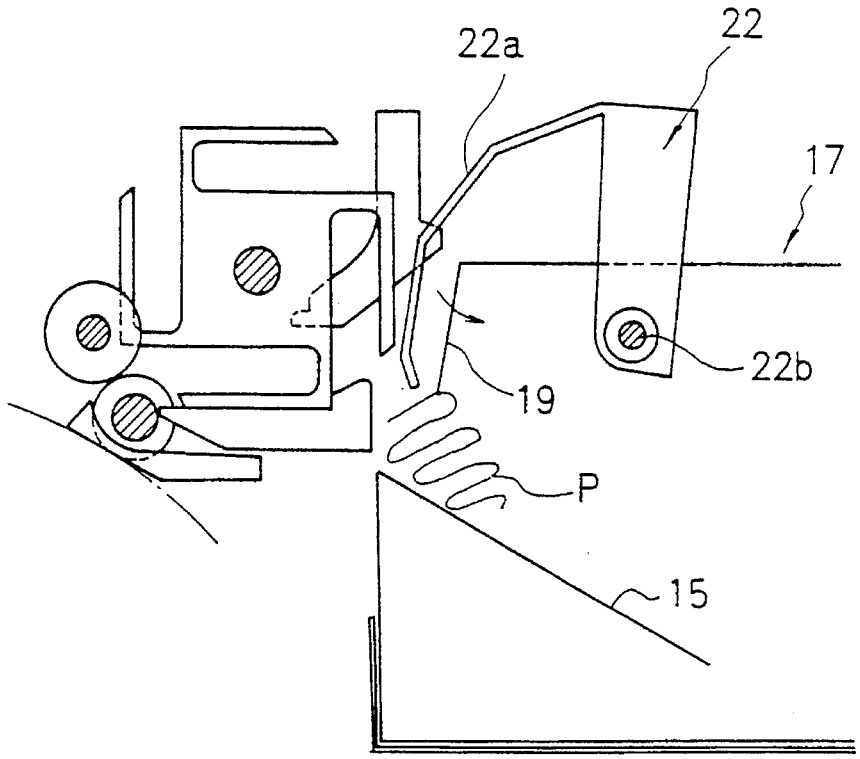
FIG. 21 is an operation diagram of the same.
Figure 22:
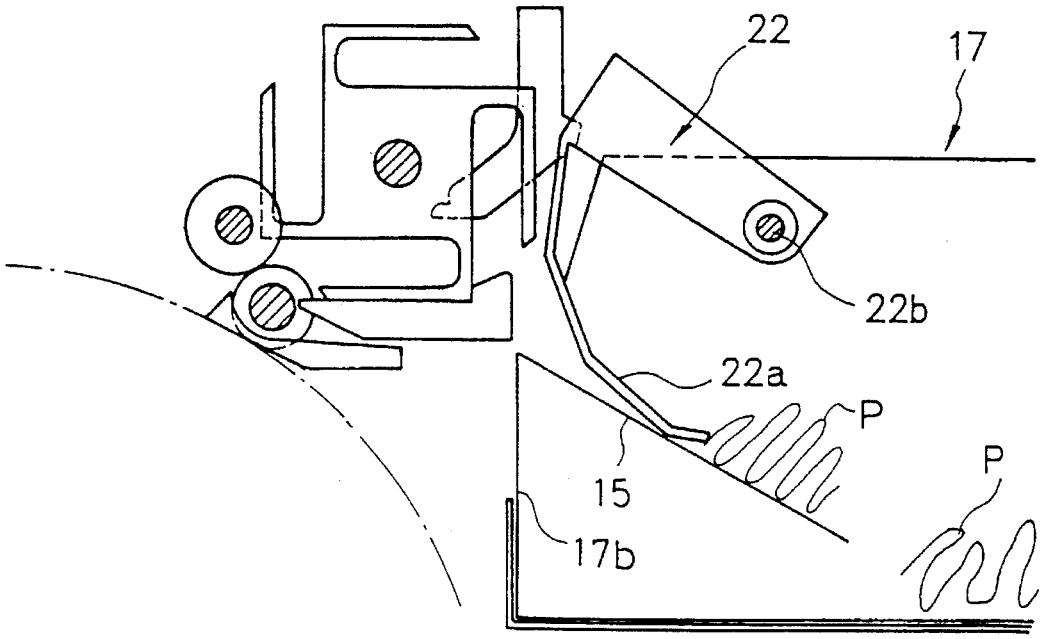
FIG. 22 is an operation diagram of the same.

Next, as shown in FIG. 21, with the normal rotation of the motor 23, the push-out means 22 operates to turn the push-out piece 22*a* as far as a specific position within the stencil discharge box 17, to thereby push out the spent stencil paper P towards the stencil discharge box 17 side. At this time, the spent stencil paper P is pushed, together with the lid 19, into the stencil discharge box 17, thus being discharged into the stencil discharge box 17 as shown in FIG. 22. The spent stencil paper P, when discharged, is sent along the inclination of the guide section 15, on the surface of the guide section 15, into the stencil discharge box 17. The spent stencil paper P is sent by this guide section 15 to about the central portion of the stencil discharge box 17, thereby preventing the gathering of the spent stencil paper P at the vicinity of the side wall 17*b* at the lower part of the receiving port 18.

Figure 23:
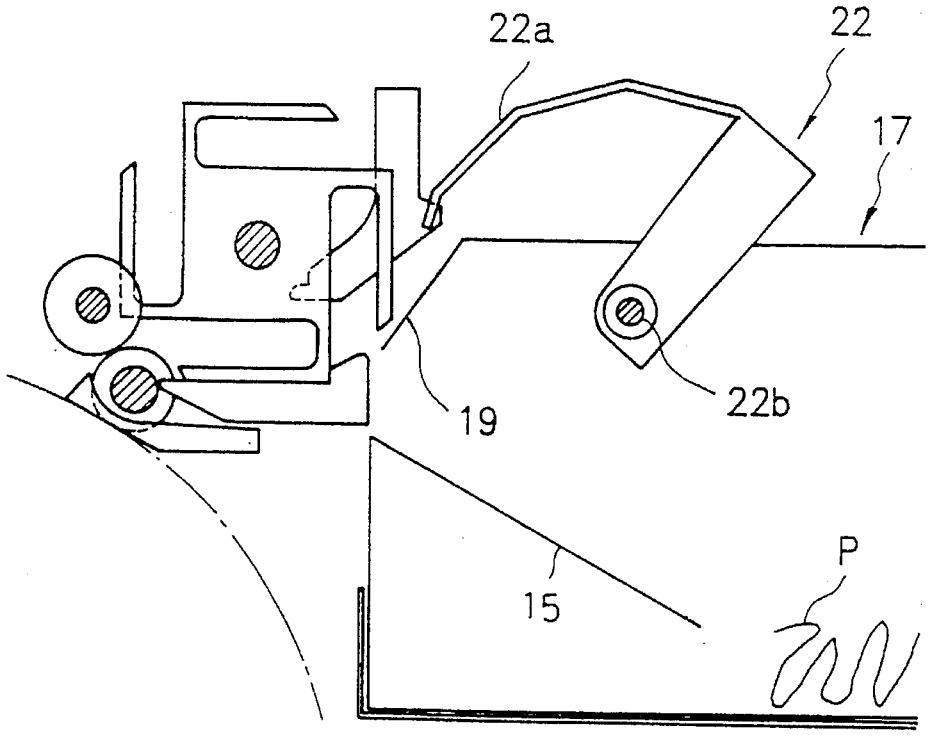
FIG. 23 is an operation diagram of the same.

Next, when the motor 23 turns reversely, the push-out means 22 stops pushing, allowing the backward movement of the lid 19 to its original position as shown in FIG. 23, that is, to the position where the movement of the spent stencil paper P coming from the rotating member 9 is prevented. It is to be noted that the number of operations of the push-out means 22 is not limited to one time but may be plural times, e.g., two or three times. The guide section 15 may be formed at an angle at which it contacts the push-out piece 22*a* of the push-out means 22, that is, at an angle at which the spent stencil paper P to be pushed in can be guided to the inside of the stencil discharge box 17. At the aforesaid angle set to a degree at which the push-out piece 22*a* of the push-out means 22 will not contact the guide section 15 when turned, a preceding spent stencil paper P that has been discharged into the stencil discharge box 17 is further pushed into the box 17 by a following spent stencil paper P newly stripped and to be discharged by the push-out piece 22*a* of the push-out means 22, without dropping outside of the side wall 17*b* on the drum side.

After the discharge of the spent stencil paper P into the stencil discharge box 17, the lid 19 returns to its original position namely, the lid 19 is present between the rotating member 9 and the stencil discharge box 17. Therefore, when the stencil discharge box 17 has become full of the spent stencil paper P and if a force acts to move the spent stencil paper P discharged into the stencil discharge box 17, backwardly towards the rotating member 9 side, the backward movement of the spent stencil paper P will be checked by the lid 19. Therefore, there will not occur such troubles as interrupted rotation of the rotating member 9, defective discharge of the spent stencil paper, and wrapping of the defectively discharged spent stencil paper around the take-up roller 4.

The spent stencil paper P discharged into the stencil discharge box 17 can be discarded outside by removing the stencil discharge box 17 itself off the mounting base 17*a* and opening the receiving port 18. At this time, if the stencil discharge box 17 is turned upside down with the receiving port 18 facing downwardly, the spent stencil paper P will not drop out of the box thanks to the elasticity of the lid 19, and accordingly will not stain the interior of the equipment with ink.

Figure 24:
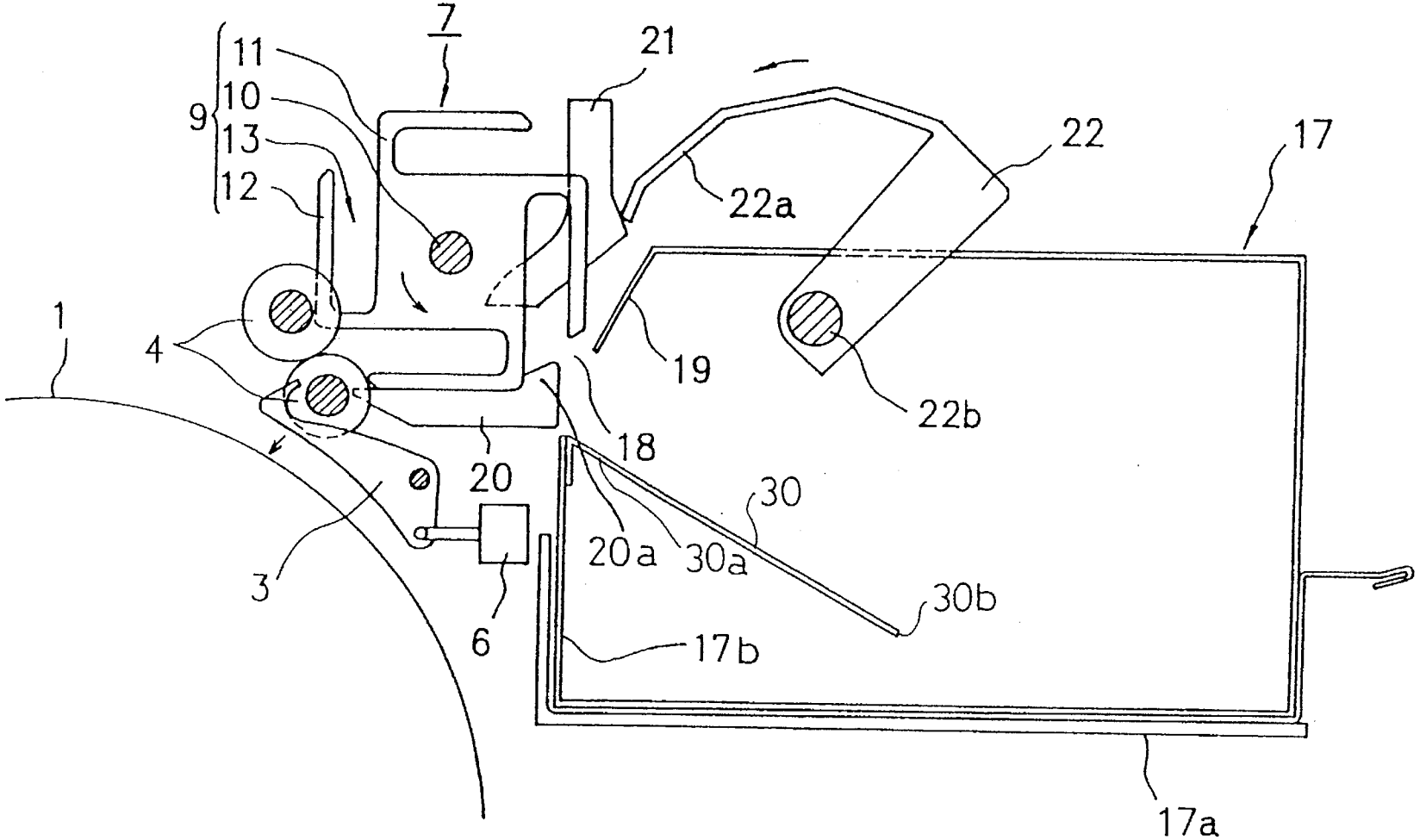
FIG. 24 is a side view showing a fifth embodiment of the stencil discharger according to the present invention.

Next, FIG. 24 is a view showing the fifth embodiment of the present invention.

In the present embodiment, there is provided a guide plate 30 made of an elastic plate member which is separate from the stencil discharge box 17, in a position similar to that of the guide section 15. One end 30*a* of this guide section 30 is fixed at the receiving port 18 portion, while the other end 30*b* is provided extending at an angle to the bottom about the center of the stencil discharge box 17.

Figure 25:
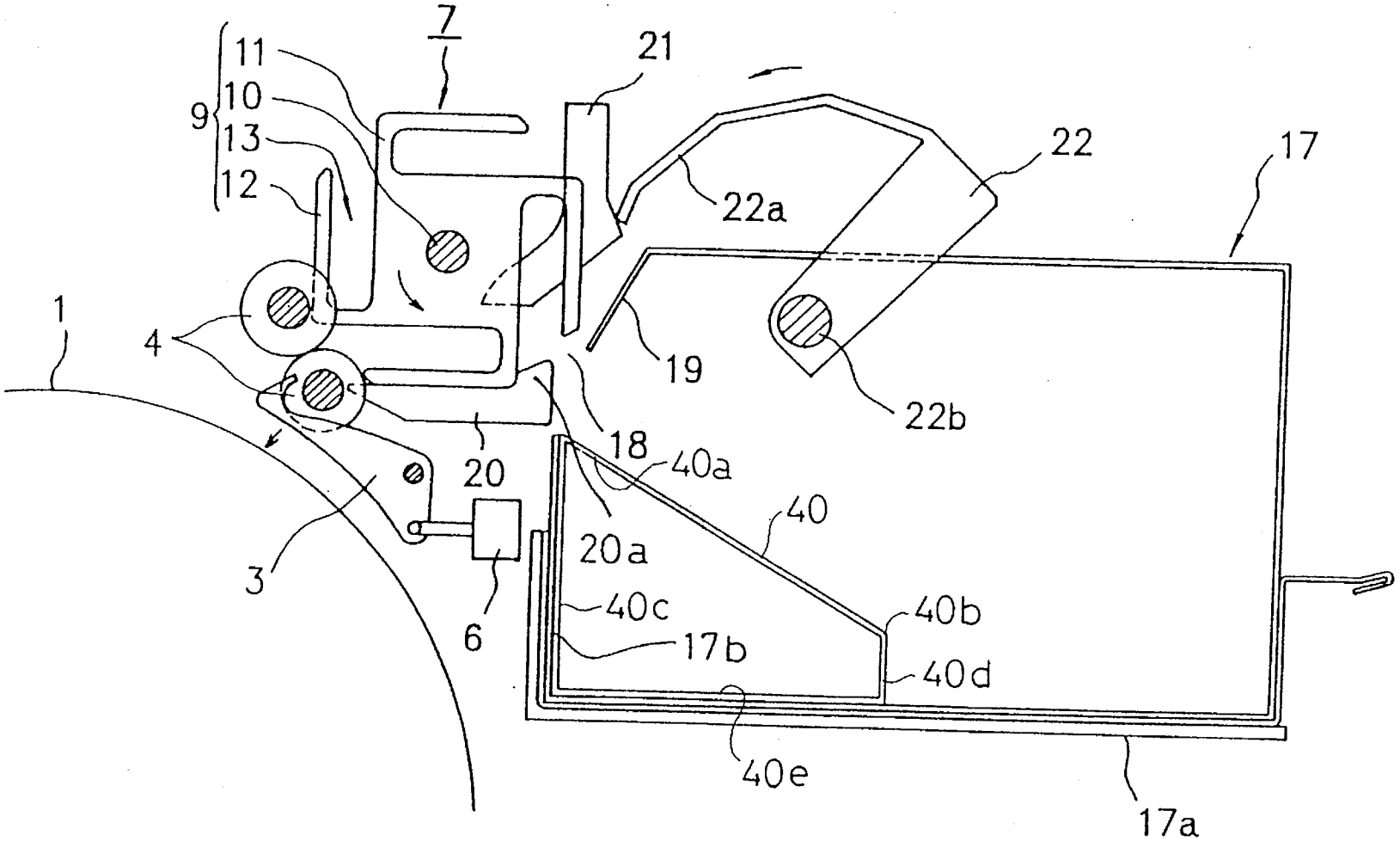
FIG. 25 is a side view showing a sixth embodiment of the stencil discharger according to the present invention.

FIG. 25 is a view showing the sixth embodiment of the present invention.

In the present embodiment, a guide body 40 made of a separate member is provided in the inside of the stencil discharge box 17. The guide body 40 is a hollow cylinder or box type one end 40*a* of the inclined surface is located in the receiving port 18 portion, while the other end 40*b* is provided at an angle at the bottom at about the center of the stencil discharge box 17. Below one end 40*a* and the other end 40*b* are erected side plates 40*c* and 40*d*. A bottom surface 40*e* is formed continuously to the side plates 40*c* and 40*d*.

In the case of the guide body 40 formed of a rigid body, the mounting angle of the guide body 40 must be set so that the rotation of the push-out means 22 will not be disturbed, that is, the tip of the push-out piece 22*a* of the push-out means 22 will not touch the inclined surface of the guide body 40, and that there can be formed a gap between a locus drawn by the tip of the push-out piece 22*a* and the inclined upper surface of the guide body 40. The spent stencil paper P will not enter into the gap between the push-out piece 22*a* and the inclined surface when the push-out piece 22*a* is rotated. When the inclined surface of the guide body 40 is formed of an elastic body, it is possible to set the angle of inclination at which the tip of the push-out piece 22*a* contacts the inclined surface, but in this case, the inclined surface is desired to be partly bent into a rib form so that the amount of deformation of the inclined surface resulting from its contact with the push-out piece 22*a* will be compensated for.

Figure 26:
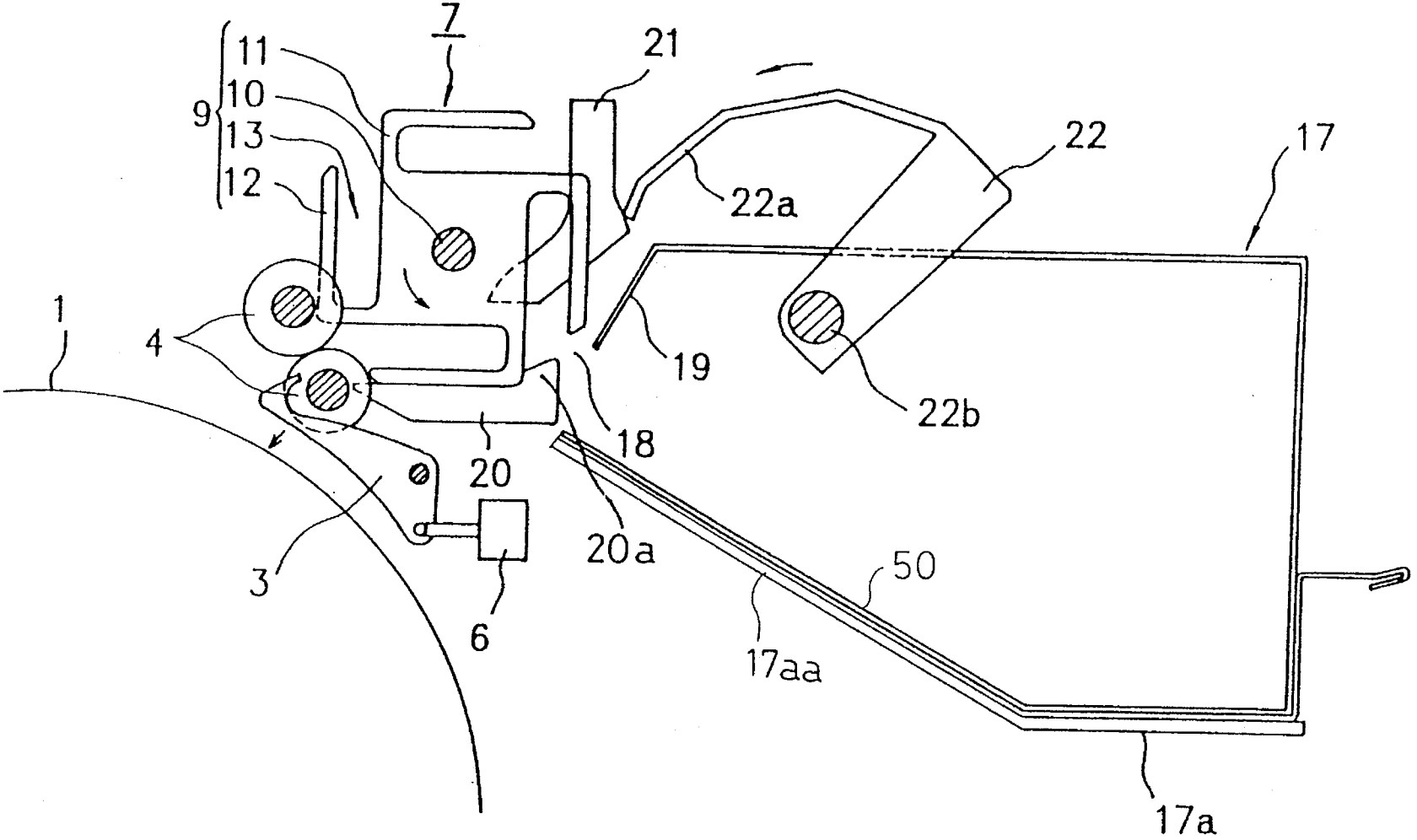
FIG. 26 is a side view showing a seventh embodiment of the stencil discharger according to the present invention.

FIG. 26 is a view showing the seventh embodiment of the present invention.

The inclined surface constituting the guide section 50, as illustrated, may be formed by cutting away the corner section of the stencil discharge box 17 itself and providing an inclined surface similar to that of the above-described guide section 15. In this case, it will become possible to easily position the stencil discharge box 17 by providing an inclined portion 17*aa* which is formed by bending, according to the shape of the stencil discharge box 17, a part of the mounting base 17*a* along the angle of inclination of the guide section 50 as illustrated.

In this case also, like the sixth embodiment shown in FIG. 25 above, the mounting angle of the guide section 50 must be set so that the rotation of the push-out means 22 will not be disturbed, that is, the tip of the push-out piece 22*a* of the push-out means 22 will not touch the inclined surface of the guide section 40, and that there can be formed a gap between a locus drawn by the tip of the push-out piece 22*a* and the inclined upper surface of the guide section 50. The spent stencil paper P will not enter into the gap between the push-out piece 22*a* and the inclined surface when the push-out piece 22*a* is rotated.

In each of the modifications stated above, the similar effects of the above-described embodiments are obtainable.

According to the present invention, since the stencil discharger is of such a constitution that, in the stencil holding section for holding spent stencil paper, an inclined guide section is provided to guide the spent stencil paper towards the inside of the holding section, it is possible to prevent the gathering of once discharged stencil paper in the vicinity of the entrance of the stencil holding section and to hold spent stencil paper at a high density in the stencil holding section. Furthermore, it is possible to prevent clogging of the spent stencil paper at the time of discharge and also to prevent the once discharged stencil paper from coming back out of the stencil discharge section.

What is claimed is:

1. A stencil discharger for discharging a stencil paper on a drum, comprising:

stripping means for stripping the stencil paper from the drum, a stencil holding section for holding the stencil paper stripped from the drum by the stripping means, transport means for transporting the stencil paper stripped from the drum to the stencil holding section through a path, a compression member situated in the path, said compression member having a first position for closing the path and a second position for opening the path, said compression member in the first position preventing transfer of the stencil paper transferred by the transport means to thereby permit the stencil paper to be compressed thereat, and in the second position allowing transfer of the stencil paper compressed at the first position to the stencil holding section, and push-out means for moving the compression member from the first position to the second position, said stencil paper compressed at the compression member being pushed from the path into the stencil holding section by the push-out, means.

2. A stencil discharger according to claim 1, wherein said compression member is immovably held at one side thereof relative to the path and has elasticity so that the compression member is bent by the push-out means.

3. A stencil discharger according to claim 1, wherein said compression member is pivotally held at one side thereof relative to the path and has means for urging the other side in a direction away from the stencil holding section.

4. A stencil discharger according to claim 1, further comprising a mounting base situated adjacent to the path, said stencil holding section being detachably disposed on the mounting base.

5. A stencil discharger according to claim 1, wherein said compression member in the first position operates to prevent the stencil paper in the stencil holding section from exiting from the stencil holding section.

6. A stencil discharger for discharging a stencil paper on a drum, comprising:

stripping means for stripping the stencil paper from the drum, a stencil holding section for holding the stencil paper stripped from the drum by the stripping means and having a receiving port, transport means for transporting the stencil paper stripped from the drum to the stencil holding section through a path, push-out means for pushing the stencil paper transferred by the transport means into the stencil holding section, an inclined guide section situated in the stencil holding section and having an inclined surface inclined inwardly downwardly in the stencil holding section from the receiving port, said inclined guide section guiding the stencil paper pushed into the stencil holding section by the push-out means inside the stencil holding section, and a compression member situated in the path of the transport means, said compression member having a first position for closing the path and a second position for opening the path, said compression member in the first position preventing transfer of the stencil paper transferred by the transport means to thereby permit the stencil paper to be compressed thereat, and in the second position allowing transfer of the compressed stencil paper to the stencil holding section, said compression member in the first position preventing the stencil paper in the stencil holding section from exiting from the stencil holding section.

7. A stencil discharge box for use in a stencil discharger, said discharger including stripping means for stripping a stencil paper from a drum, transport means for transporting the stencil paper stripped from the drum to a predetermined pre-discharge position, and push-out means for pushing the stencil paper transferred by the transport means into a discharge position in the stencil discharge box, said stencil discharge box being detachably situated in the pre-discharge position and comprising, a receiving port for receiving the stencil paper pushed out by the push-out means, and a compression member located in a path from the transport means, said compression member having a first position for closing the path and a second position for opening the path, said compression member in the first position preventing transfer of the stencil paper transferred by the transport means to thereby permit the stencil paper to be compressed thereat, and in the second position allowing transfer of the compressed stencil paper to the stencil holding section.

8. A stencil discharge box according to claim 7, further comprising an inclined guide section for guiding the stencil paper downwardly from the receiving port.

9. A stencil discharge box according to claim 8, wherein said guide section is integrally formed with the stencil discharge box at a lower portion of the receiving port.

10. A stencil discharge box according to claim 9, wherein said guide section has elasticity so as to swing at the lower portion of the receiving port when the guide section is pushed.

11. A stencil discharge box according to claim 9, wherein said guide section has elasticity to return to an original position after the guide section is pushed.

12. A stencil discharge box according to claim 8, wherein said guide section is formed separately from the stencil discharge box, and is fixed to the stencil discharge box.

13. A stencil discharge box according to claim 8, wherein said discharge box includes an inclined bottom surface extending to the receiving port, which constitutes the guide section.

14. A stencil discharge box according to claim 7, wherein said compression member in the first position operates to prevent the stencil paper in the stencil holding section from exiting from the stencil holding section.

* * * * *